United States Patent [19]

Rudy

[11] 4,097,043

[45] Jun. 27, 1978

[54] PLAYGROUND CLIMBER

[75] Inventor: Richard Rudy, Reedsville, Pa.

[73] Assignee: Kilgore Corporation, Toone, Tenn.

[21] Appl. No.: 659,686

[22] Filed: Feb. 20, 1976

[51] Int. Cl.[2] ..... A63B 9/00

[52] U.S. Cl. ..... 272/113; 52/81; 52/DIG. 10; 52/648; 403/172

[58] Field of Search ..... 272/113, 78, 56.5 R; 46/27, 28, 29; 52/81, DIG. 10, 648; 403/172, 176, 217; 35/29 E, 29 R, 16; D34/5

[56] References Cited

U.S. PATENT DOCUMENTS

| | | | |
|---|---|---|---|
| 1,359,643 | 11/1920 | Wiselogel | 403/172 |
| 1,623,956 | 4/1927 | Amiot | 403/172 |
| 3,354,591 | 11/1967 | Fuller | 52/637 X |
| 3,685,221 | 8/1972 | Mangan | 52/DIG. 10 |
| 3,785,096 | 1/1974 | Neuhardt | 52/DIG. 10 |
| 3,861,107 | 1/1975 | Papayoti | 403/172 |

*Primary Examiner*—William R. Browne
*Attorney, Agent, or Firm*—Browdy and Neimark

[57] ABSTRACT

A playground climber comprises one or more equally sized dodecahedron-shaped modules, two or more of which of equal size are joined together along a face of each. The modules are each made up of pieces of pipe of equal length attached together at their ends using a connector, each module having twelve faces and twenty corners, each face having five sides, and each corner being formed by the juncture of three pipes. Each module is a regular dodecahedron with structural members so positioned that a child can reach the members. Also, the majority of the faces of the dodecahedrons are open to permit a child to pass therethrough. The structural members of each face of each dodecahedron are spaced close enough to each other to permit a child to grasp the structural members of a regular pentagon, which forms each face of the dodecahedron, while climbing thereon.

5 Claims, 5 Drawing Figures

FIG. 1
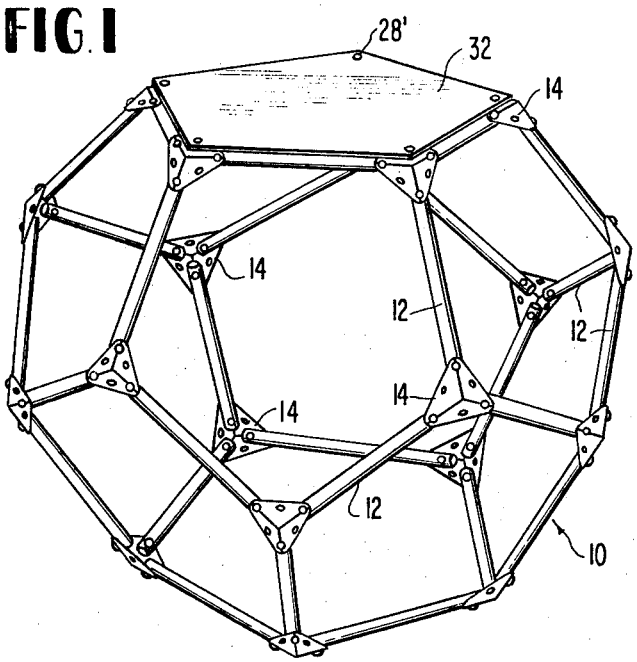
FIG. 3
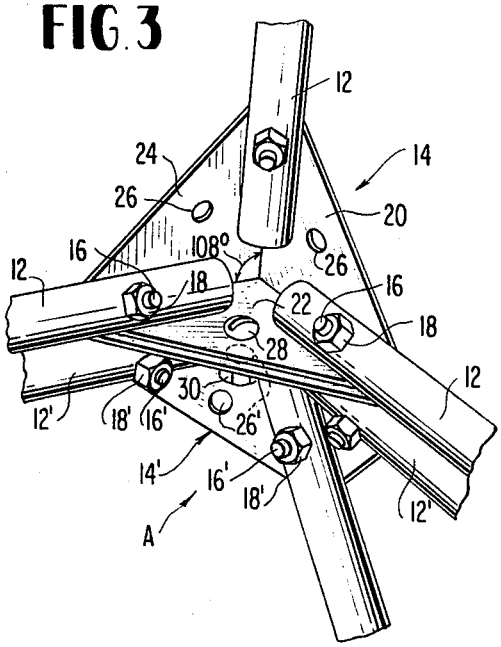
FIG. 4
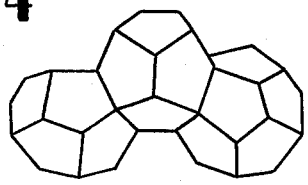
FIG. 5
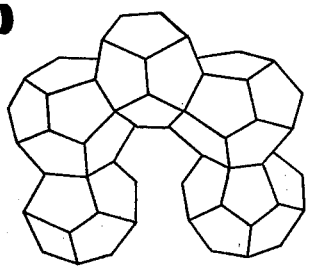
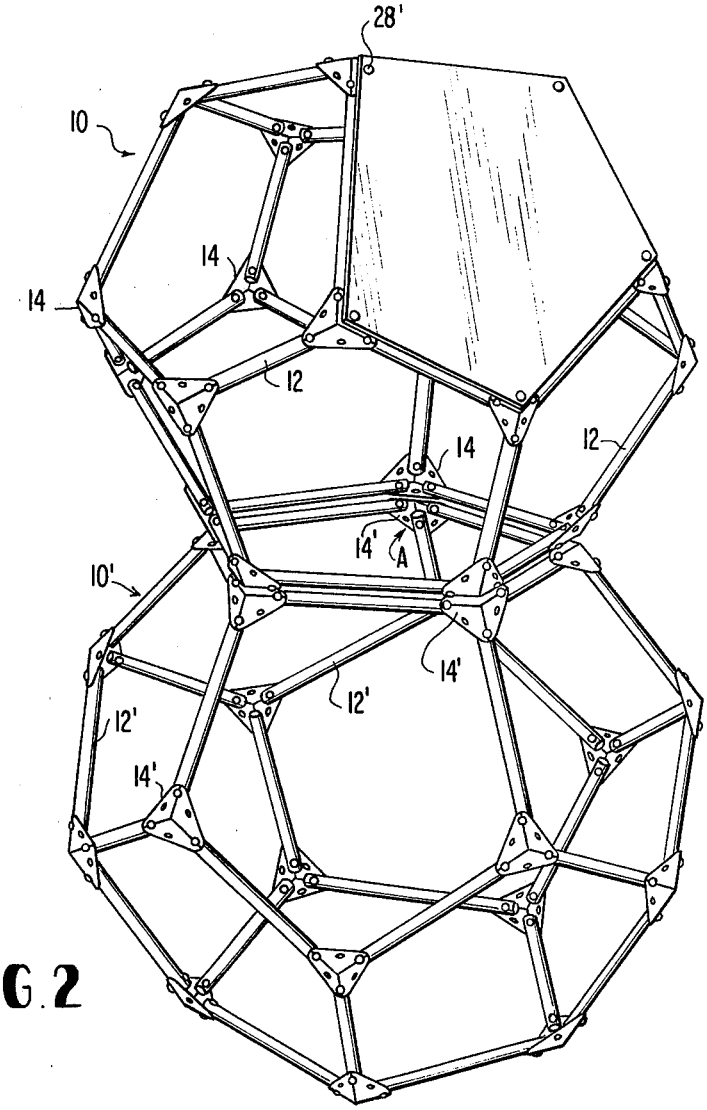
FIG. 2

PLAYGROUND CLIMBER

FIELD OF INVENION

The present invention relates to playground equipment and, more particularly, to a playground climber in modular form capable of being assembled into climbers of various sizes

BACKGROUND OF THE INVENTION

Geodesic-type climbers of various types of use as playground equipment are well known. However, for one or more reasons, each of the previous constructions available has not been fully satisfactory. Thus, some of these constructions are available only in one size which for certain playgrounds may be either too large or too small. Other constructions are unduly complex and unduly expensive to manufacture. Among the former type are those shown in U.S. Design Pat. Nos. 187,138 and 224,796, as well as a structure commercially available known as the "Geodesic Climber" by Jamison, inc. Among the latter types is the type shown in U.S. Design Pat. No. 218,455 and U.S. Utility Pat. No. 3,632,109.

Of course, the geodesic principle has been used in other types of construction, namely building structure noting the Nye U.S. Pat. Nos. 3,137,371; the Sturm 3,220,152; the Sadao 3,810,336; the Baker 3,854,255. Of these the Nye patent is of interest in that it is made up of pipes put together by connectors to form the structure, with the faces being three-sided and each corner being formed by the juncture of five or six pipes, a construction similar to that of the Jamison Geodesic Climber.

Summary

It is, accordingly, an object of the present invention to overcome the deficiencies of the prior art, such as indicated above.

It is another object to provide improved climbing equipment, such as for use in a playground.

It is yet another object of the present invention to provide climbing equipment which is versatile, sturdy and inexpensive.

These and other objects and advantages of the instant invention, which will become more clear from the following detailed description of specific embodiments, are achieved by the provision of a dodecahedron-shaped module made up of strut elements joined together, each module having not only twelve faces, each of which have five sides, but also twenty corners, each formed by the juncture of three such struts. The modules may be used either individually, or they may be connected together using from two to as many as twelve or more modules to make various configurations of climbing equipment for playgrounds or the like.

Brief Description of the Drawings

For a better understanding of the invention, possible embodiments thereof will now be described with reference to the attached drawings, it being understood that such embodiments are intended as merely exemplary and in no limitative.

FIG. 1 is a perspective view of an embodiment of a single module in accordance with the present invention;

FIG. 2 is a perspective view of two of the modules of FIG. 1 connected together;

FIG. 3 is a broken-away detailed view showing an embodiment of the connection between two modules at one corner of a connecting face; and FIGS. 4 and 5 are schematic perspective views showing different ways in which various numbers of modules may be connected.

Detailed Description of Embodiments

A geodesic-type module 10 in accordance with the present invention is shown in FIG. 1. Such a module 10, which may be constructed in various sizes, is formed of a plurality of pieces of pipe 12 which meet at corner elements 14. It will be seen that the module 10 has twelve faces and is accordingly dodecahedron-shaped. Each face is formed of five pipes 12 and is therefore an equilateral pentagon.

It will be noted that each module 10 has twenty corners which, in the illustrated embodiment, comprise the corner pieces 14. Each corner is formed by the juncture of three pipes 12 which, in the illustrated embodiment, are individually bolted to such a corner piece 14. Thus, each pipe 12 is provided with two holes, such as punched holes or drilled holes, one being provided at each end. Noting FIG. 3, it is seen that each pipe 12 is bolted to a corner piece 14 by a bolt 16 which passes through the hole in the end of the pipe 12 and through a corresponding hole in the corner piece 14, the bolt being secured with a suitable nut 18, such as a lock nut.

The corner pieces 14 are each formed by three intersecting planar portions 20, 22 and 24 which meet each other at angles of 108°. Each of the corner pieces 14 are provided with six holes, three of which as noted above are provided along the intersection of adjacent plane portions and are for the purpose of bolting the pipes 12 to the corner piece 14. The other three holes 26 are each located in one of the planes, such as at the center thereof, and the purpose of these holes 26 will be explained below.

Referring to FIG. 2, there is shown an embodiment in which two of the modules are bolted together, in this case the module 10 of FIG. 1 with an essentially identical module 10', comprising pipes 12' which are joined, three together, at corner pieces 14'. It will be seen from FIG. 2, that in attaching the modules 10 and 10', one pentagonal face of each of these are placed adjacent to the other. A typical joined corner A as shown in FIG. 2 is shown in more detail in FIG. 3. Actual connection is carried out at each of the five corners. A bolt 28 is passed through the hole 26 in the plane 22 of each corner piece 14 of the pentagonal face of module 10 adjacent module 10' and then through an equivalent hole 26' in the plate 22' of the corner piece 14' of the pentagonal face of the module 10' lying adjacent the module 10. A suitable nut 30 threaded on to the bolt 28 completes the fastening.

Referring back to FIG. 1, it is seen that the modules may optionally be provided with one or more panels 32, which are of a size and shape equivalent to a face of the dodecahedron-shaped module, i.e., the panels 32 are of equilateral pentagon shape. These panels are attached to the corner pieces 14 with bolts 28' which, like the bolts 28 of FIG. 3, pass through the holes 26 in the corner pieces 14. The panels 32 can serve as a platform upon which a child can stand, or they may be used merely for decorative purposes.

FIGS. 4 and 5 merely show two schematic representations, in perspective, of how the modules may be assembled in, respectively, three and five module constructions. It will be understood that any number of modules may be connected, and in a great variety of configurations of from two modules up to twelve or even more. The types of configurations possible are limited only by the imagination.

The functionality of the construction of the present invention wil be readily apparent. When playing on a cluster of the dodecahedrons, alert young minds quickly convert them into bridges, caves, canyons and fortresses. The system offers great flexibility in that a small grouping of three or four can easily be expanded to meet the growth requirements of any playground.

The construction is extremely sturdy, yet of relatively low cost. The pipes may be standard steel pipes, such as 1-⅝ inch outer diameter steel pipe, and the corner brackets may be easily fabricated from steel as well, such as 3/16 inch formed steel.

It wil be obvious to those skilled in the art that various changes may be made without departing from the scope of the invention and the invention is not to be considered limited to what is described in the specification. For example, struts other than steel pipe may be used; also the corner elements may be of form and construction other than that exemplified.

What is claimed is:

1. A playground climber, comprising a plurality of modular units connected to one another, each said modular unit being a regular dodecahedron formed of interconnecting dodecahedron structural member means having generally cylindrical climbing interconnecting struts on the face of the dodecahedron so closely spaced a child could stand on one strut and grasp any of the other struts of the face on which the child is climbing, each face of each dodecahedron unit comprising a regular pentagon and a majority of said faces being open to permit a child to pass therethrough climbing thereon and grasping of said climbing struts by a child, each said pentagon comprising five climbing struts with two said adjacent struts meeting at an angle of 108°, each said dodecahedron unit having twenty corners, and each said corner being formed by the juncture of three of said climbing struts whereby a child can climb said playground climber by grasping and placing his feet on said struts which form each face of each unit.

2. A playground climber in accordance with claim 1 wherein two adjacent of said modular units are in face-to-face relationship and attached to one another at the corners of the adjacent faces.

3. A playground climber in accordance with claim 2, wherein said climbing struts are formed of steel pipe, and said corners are formed of corner elements, each of which receives the ends of three said pipes, each said end being bolted to a said corner element.

4. A playground climber in accordance with claim 3, wherein said corner elements have holes passing therethrough, and wherein the connection between adjacent faces of two modular unit is by means of bolts passing through said holes in said corner elements.

5. A playground climber in accordance with claim 4, having a regular pentagon-shaped panel attached to one of the faces of at least one of said dodecahedrons, said panel being of a size equal to the size of the face of said dodecahedron to which it is attached.

* * * * *